United States Patent [19]

Kuzumi

[11] Patent Number: 4,564,848

[45] Date of Patent: Jan. 14, 1986

[54] PRINTER

[75] Inventor: Tadayuki Kuzumi, Kawasaki, Japan

[73] Assignee: Kyocera Corporation, Japan

[21] Appl. No.: 594,677

[22] Filed: Mar. 29, 1984

[30] Foreign Application Priority Data

Mar. 30, 1983 [JP] Japan ..... 58-52467
Mar. 30, 1983 [JP] Japan ..... 58-52469

[51] Int. Cl.[4] ..... H05D 1/100

[52] U.S. Cl. ..... 346/76 PH; 346/106; 400/208

[58] Field of Search ..... 400/194–196, 400/120, 207, 208; 346/76 R, 76 PH, 105, 106; 219/216 PH, 216; 250/319; 101/336

[56] References Cited

U.S. PATENT DOCUMENTS 3,855,448 12/1974 Hanagata et al. ..... 346/76 PH
4,388,006 6/1983 Waibel ..... 400/196
4,468,139 8/1984 Hattori ..... 400/196

*Primary Examiner*—E. A. Goldberg
*Assistant Examiner*—A. G. Evans
*Attorney, Agent, or Firm*—Spensley Horn Jubas & Lubitz

[57] ABSTRACT

Disclosed is a printer having a plurality of heating elements disposed on a thermal head which generate heat to melt a transfer material coated on a printing tape and transfer it onto a recording medium. The printer comprises a printer body having a recording paper setting device, a thermal head and head feed mechanism, and a tape cassette mounted vertically along the front of the printer body, which contains the printing tape. The invention is characterized in that the tape cassette stretches the printing tape throughout the overall length of space provided for movement of the thermal head. While the printing tape is held stationary, the head is moved in a stepping manner at every printing and is then fed for one character without printing after reaching the end of the print line. Thereafter, the head is restored to the beginning of the next print line, and the used tape is simultaneously wound onto a take-up spool in the cassette at a speed of substantially zero relative to the restoration of the thermal head to the beginning of the next print line.

9 Claims, 14 Drawing Figures

PRINTER

FIELD OF THE INVENTION

This invention relates to a printer of transfer and recording process, in which a number of heating elements disposed on a thermal head are allowed to selectively generate heat to thereby melt a transfer agent coating on a tape and carry out transfer and printing on a recording paper.

BACKGROUND OF THE INVENTION

The printer has hitherto been well known which places on the recording paper the transfer tape coated with a thermalmeltable transfer agent and heats the transfer agent from the back of the tape by means of the thermal head to stick and transfer the agent onto the recording paper. Such printer as shown in FIG. 1 has hitherto been used.

Explanation in brief will be given on the above construction in accordance with FIG. 1, in which at both sides of a base 201 are erected side plates 202 and 203 for mounting thereto various members to be discussed below. A carriage 204 is mounted to a guide shaft 205 slidably in parallel to a platen shaft 206, and has at the center a thermal head 208 and at both sides thereof guide rollers 211 for press-contacting a transfer tape 109 onto a recording paper 10, so that a tape cassette 212 is adapted to be mounted on the carriage 204 and provides a tape supply spool 214 and a tape take-up spool 215 laterally juxtaposed and forms a vacancy for containing therein the thermal head 208 and guide rollers 211, the vacancy being of a recess 212*a* formed between both the spools 214 and 215 and at the platen 206.

The transfer tape 109 drawn out from the supply spool 214 is inserted between the recording paper 10 and the thermal head 208 and then wound onto the take-up spool 215.

The carriage 204 operates to wind the tape 109 and move step by step at every printing by means of a drive belt 217 driven through pulleys 216 by a drive motor (not shown), and, during the return of carriage 204, is slightly raised by a plunger 219 through a lever (not shown) to move the thermal head 208 away from the recording paper 10, thereby returning to the beginning of the line.

A feed roller 220 carries out line spacing of recording paper 10 by a pulse motor 221.

Rollers 222 are fitted rotatably onto a shaft 223 and for holding the paper 10. Such conventional construction has been defective in the following points:

(a) The tape cassette 212 and carriage 204 therefor are disposed in parallel to the base 201, in other words, in the horizontal plane, whereby the printer as a whole expands in depth by longitudinal dimension of carriage 204;

(b) The carriage 204 requires a space through which it moves in parallel with respect to the platen shaft 206, thereby reducing to that extent the space for housing the necessary mechanism;

(c) Since the thermal head 208 is disposed between both the spools 214 and 215 in the tape cassette 212, spaces for moving the carriage 204 should be insured also at both outsides of the maximum printing width, thereby enlarging the printer in lengthwise length to an extent of moving dimension of carriage 204;

(d) Also, in the driving system, every printing requires winding-up of tape 109 and movement of carriage 204 in a stepped manner, thereby inevitably requiring an increase in power consumption and the use of a drive motor of large rated output. Such need of large power consumption has made it impossible to materialize a portable printer driven by batteries; and (e) Generally, upon peeling off the transfer tape 109 from the paper 10 while the transfer agent is still molten just after printing, the dotted portions come out to deteriorate the printing quality. Therefore, for the aforesaid mechanism which winds up the transfer tape 109 at every printing, the tape 109 should be peeled or wound up after a certain time from printing, which inevitably restricts the printing speed to some extent, resulting in that the printing at high speed has been impossible.

SUMMARY OF THE INVENTION

In order to eliminate the above defects, this invention has been designed. This invention is characterized in that the printer body is provided with a printing feed mechanism for the thermal head, a return mechanism to return the thermal head to the beginning of a line, and a recording paper setting mechanism, the transfer tape is stretched between the thermal head and the platen in an overall length of movement of the head along the platen, the head only is moved in a stepping manner at every printing and then is fed for one character without printing after having printed to the line end and thereafter is restored to the line head, and simultaneously, the tape is wound up to the take-up spool at the speed of substantially zero relative to the restoration of the thermal head. An object of the invention is to provide a printer which minimizes the space for movement of the head and reduces the depth or width of the printer as a whole for miniaturization and lightweight design of the printer. Additionally, it is not troublesome to feed the tape at every printing, because the thermal head is fed for one character without printing after printing one complete line and then returns to the line head and simultaneously the tape after use is wound up, whereby the tape feeding is simplified, a compact motor of stable rated output is usable, the power consumption, the operating cost and manufacturing cost are saved, and a portable printer using batteries is realizable.

These and other objects of the invention will become more apparent in the detailed description and examples which follow.

BRIEF DESCRIPTION OF THE DRAWINGS

FIGS. 7 and 8 are structural views of the printing unit, in which

FIG. 7 is a rear view thereof, and

FIG. 8 is a front view of the principal portion of the same.

FIGS. 11 through 14 are structural views of components at the cassette mounting mechanism, in which FIG. 11 is a front view thereof, FIG. 12 is a plan view of the principal portion of the same, FIG. 13 is a front view showing the tape cassette in charging condition, and FIG. 14 is a right-hand side view thereof.

DETAILED DESCRIPTION OF THE INVENTION

Figure 1:
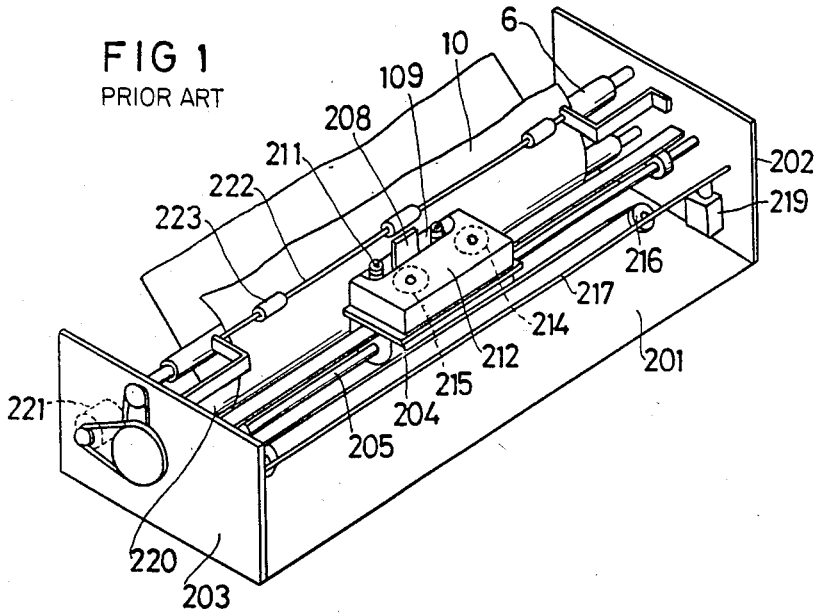
FIG 1 PRIOR ART
FIG. 1 is a perspective view of a conventional printer.
Figure 2:
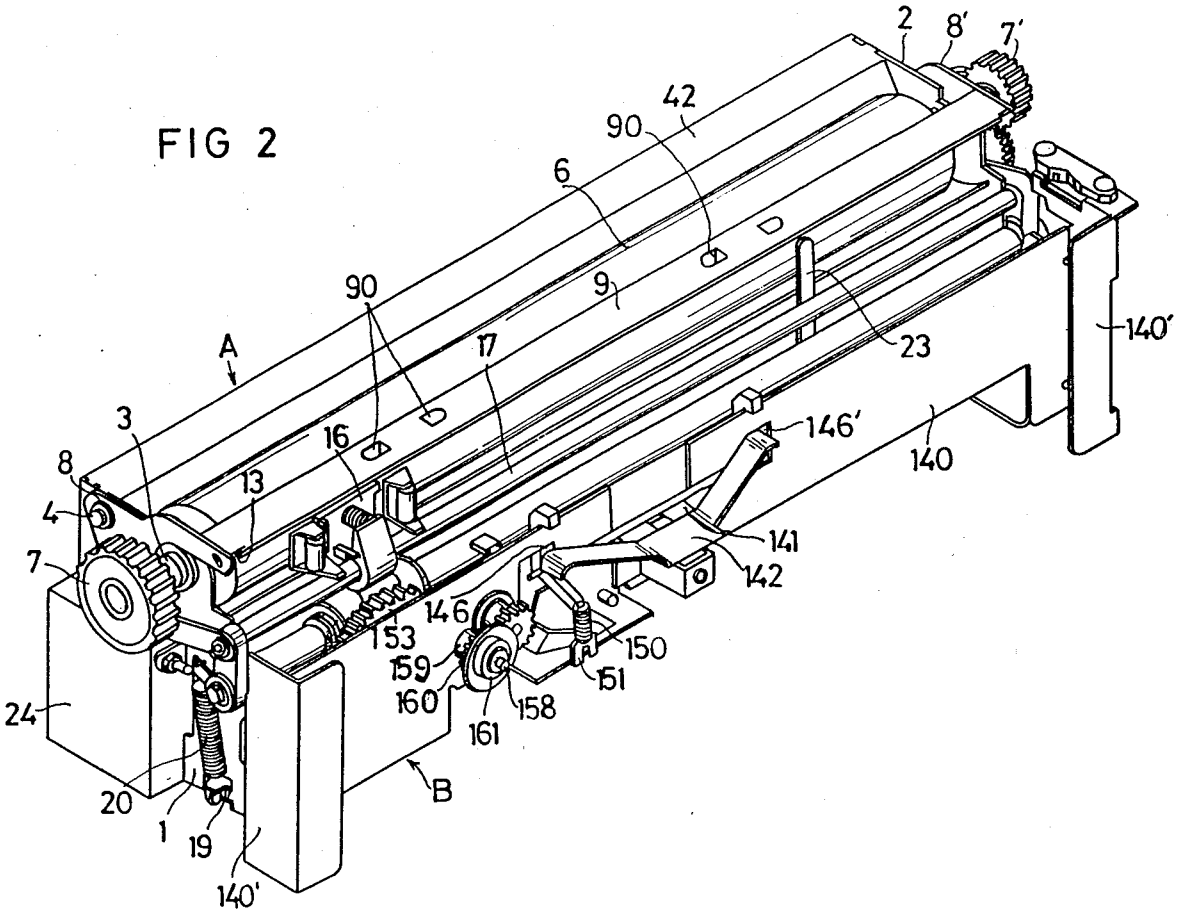
FIG. 2 is a perspective general view of an embodiment of a printer of the inventionl.

In FIG. 2, reference A designates the printer body having a paper feed mechanism and a printing mechanism, and B designates a cassette mounting mechanism fixed detachably to the printer body A, into which a tape cassette C (see FIG. 10) is chargeable.

Figure 3:
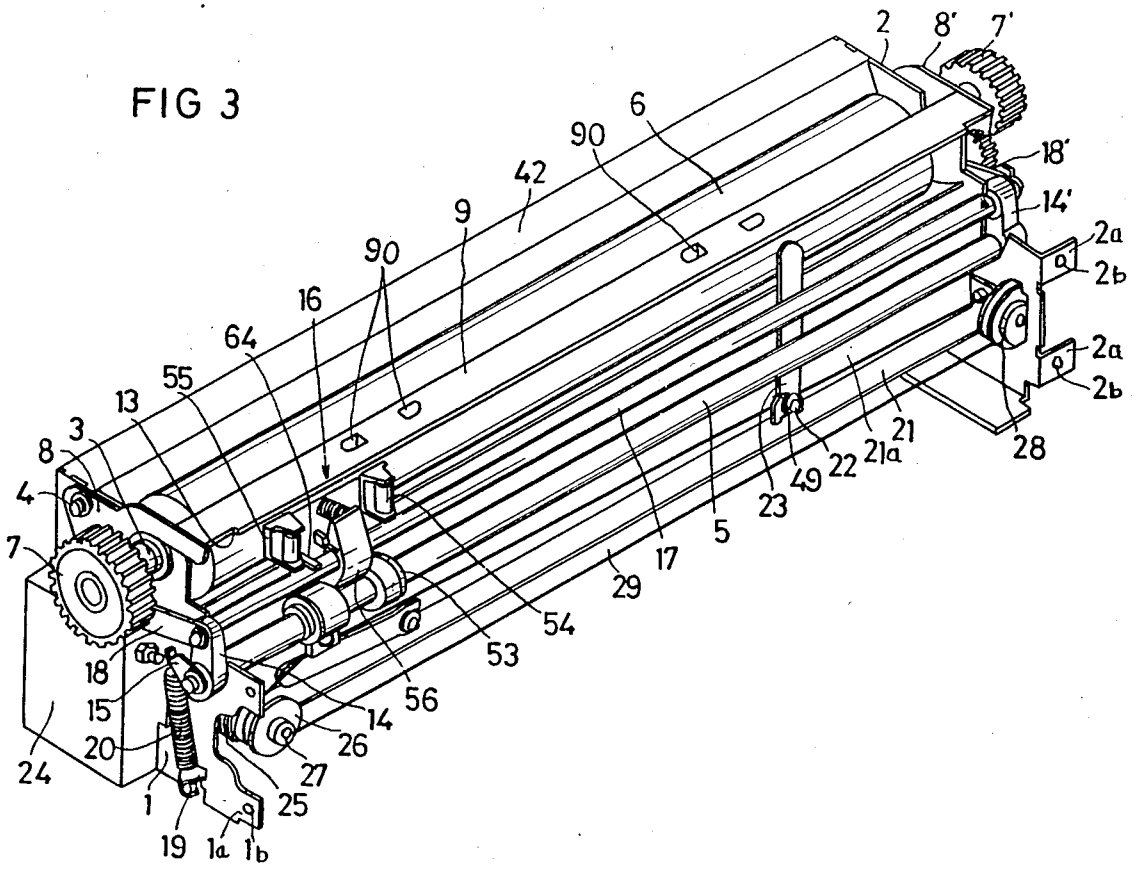
FIG. 3 is a perspective view of the printer in the FIG. 2 embodiment, from which a cassette mounting mechanism is removed.

Referring to FIG. 3, a left side plate 1, a right side plate 2 and a stay (not shown), constitute a frame, both the side plates 1 and 2 having at the front ends 1*a* and 2*a* screw 1*b* and 2*b* bored vertically and for fixing the cassette mounting mechanism b respectively, the screw bores 2*b* being formed at the front ends 2*a* of right side plate 2 bending at right angles for the convenience of mounting the cassette mounting mechanism B.

Also, between both the side plates 1 and 2 are journalled a platen shaft 3, a handle support shaft 4 and a guide shaft 5 in parallel to each other.

The platen shaft 3, as well known, carries a platen 6 of elastic material sleeved onto the same and has at both axial ends control dials 7 and 7′ for manually feeding the recording paper.

Handle arm plates 8 and 8′ are fixed to both axial ends of handle support shaft 4, and extend horizontally beyond the shaft 3 respectively to thereby support at the utmost ends a handle 9 extending in parallel to the platen shaft 3.

The handle 9 is cut at optional portions on the upper surface and bent downwardly in parallel to the side plates 1 and 2 thereby form tongues 90 for rotatably mounting a paper holding roller 12 therebetween through a roller shaft 11 (see FIG. 4), and also folded back at the one side edges at both ends and at the cassette mounting mechanism B side to thereby form cutters 13 for cutting the recording paper.

At both axial ends of guide shaft 5 are fixed fixing members 14 and 14′ extending upwardly and retaining members 15 and 15′ extending laterally, and a sliding shaft 17 perforating a printing unit 16 is journalled to the fixing members 14 and 14′ and extends in parallel to the guide shaft 5.

Linkage members 18 and 18′ are pivoted at one end rotatably to both the axial ends of sliding shaft 17, and at the utmost ends of retaining members 15 and 15′ are retained one end of coil springs 20 and 20′ retained at the other end to bent segments 19 and 19′ at the lower portions of side plates 1 and 2 respectively.

A stay 21 of a L-like shape in section is provided between the side plates 1 and 2 at the portions thereof below the guide shaft 5 and extends in parallel thereto, a paper holding plate 23 is mounted rotatably through a stem 22 to one widthwise end of a rising wall 21*a* of stay 21.

Figure 7:
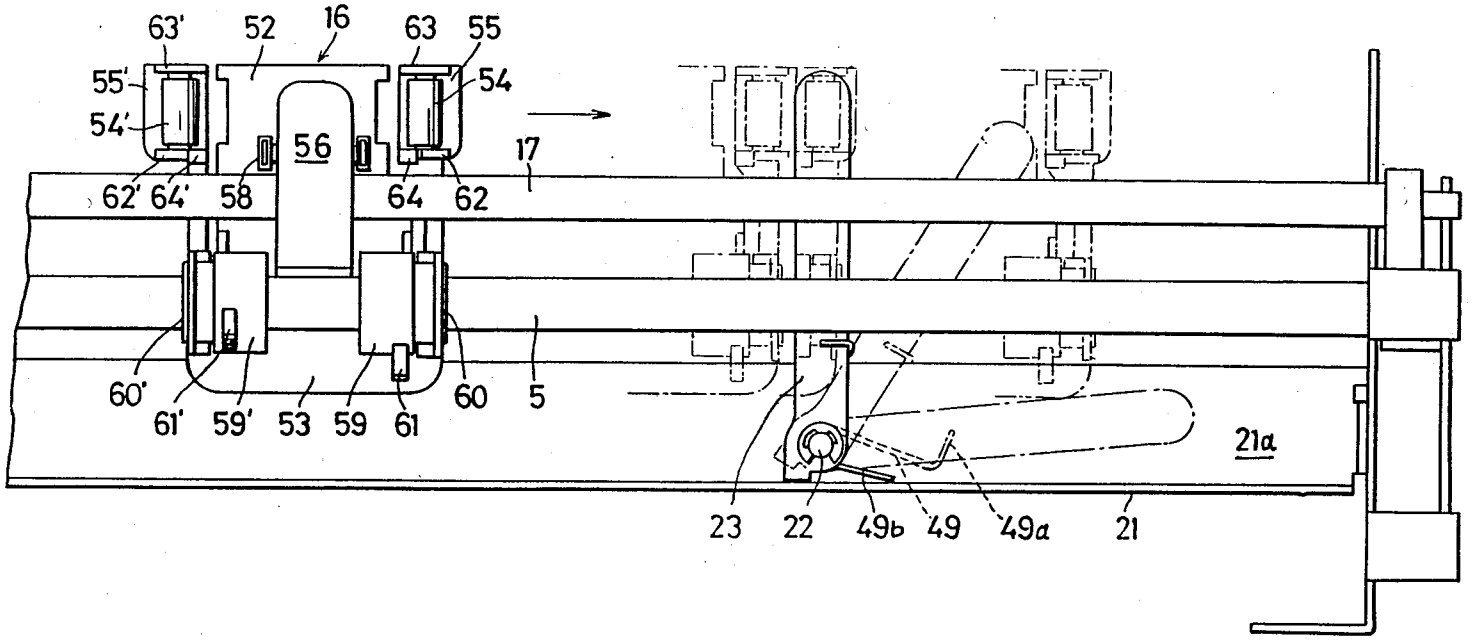

Reference numeral 49 designates a bar spring for holding the paper holder plate 23. The bar spring 49, as shown in FIG. 7, is fitted at its central coiled portion onto a shaft 22 for the paper holder 23, bent at one end 49*a* to be retained to the side edge of holder 23, and press-contacts at the other end 49*b* with the horizontal plate of stay 21.

Hence, the paper holder 23 normally stands upright to abut at the utmost end against the surface of platen 6 and falls down toward the side plate 2 as the printing unit moves and also returns (stands upright) when the unit 16 moves away from the holder 23.

Thus, the paper holder 23, which stands upright or falls down in association with movement of printing unit 16, can be disposed at the most suitable position with respect to the outer periphery of platen 6 and prevent the recording paper from warping when fed and from jamming at the utmost end with the transfer tape.

At the left side plate 1 is disposed a pulse motor 24 for transporting the printing unit 16 and winding up the transfer tape 109 and a drive shaft 25 of motor 24 fixedly supports a pulley 26 at the end (at the cassette mounting mechanism B side) and projects at the utmost end from the surface of pulley 26 to serve as a mounting shaft 27 for a gear 152 (see FIG. 12) containing a one-way clutch to be discussed below. Belt 29 is stretched between said pulley 26 and the other pulley 28 rotatably provided on the part of the right side plate 2. Both ends of said belt 29 are fixed respectively to fixing members 61 and 61′ (see FIG. 7) of a printing unit 16 slidably mounted on said guide shaft 5. As a result, the pulse motor 24 is driven to rotate the belt 29 to enable the printing unit 16 to feed the printing and return to the printing start position.

In addition, the printing unit 16, which is perforated by the guide shaft 5 and sliding shaft 17, does not swing during the movement, thereby performing stable transportation while being put into press-contact under a constant resilient force with the platen 6.

Figure 4:
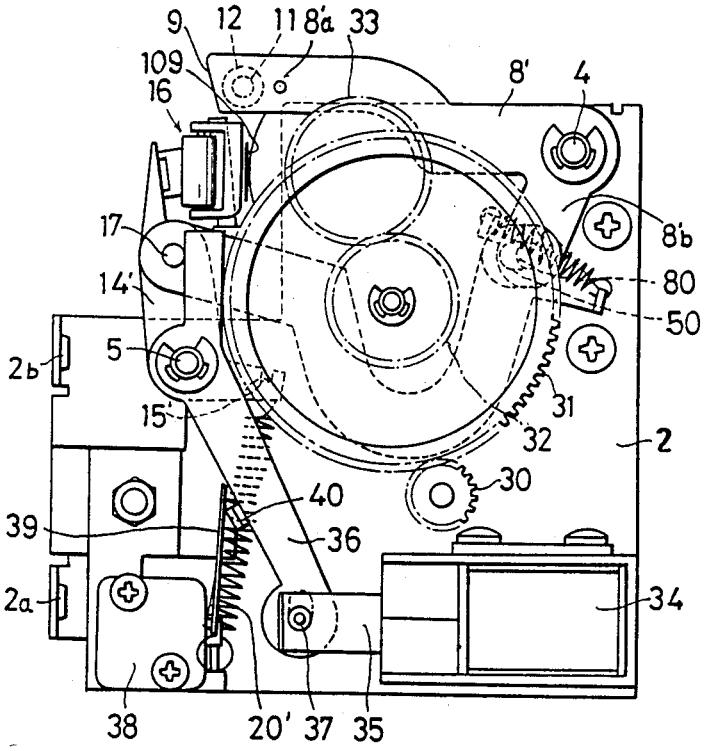
FIG. 4 is a right-hand side view of the printer body in FIG. 3.

Now, referring to FIG. 4, the right-hand side of printer body A is shown, in which reference numeral 30 designates a drive gear connected directly with a stepping motor (not shown), which is connected to a gear 33 connected through speed-reduction gears 31 and 32 to a gear 33 connected directly to the platen shaft 3 which carries out the line spacing of platen 6.

Reference numeral 34 designates a solenoid which disposes its drive shaft 35 at the lower end at the handle support shaft 4 side and horizontally toward the printing unit 16.

Reference numeral 36 designates a link lever pivoted at one end freely to the tip of drive shaft 35 at the solenoid 34 through a shaft 37, which is pivoted at the other end to the guide shaft 5 and further extends upwardly so as to enable its abutting against the outer periphery of reduction gear 31 when the drive shaft 35 moves forwardly.

In such construction, the guide shaft 5 and the sliding shaft 17 connected thereto through the fixing members 14 and 14′, rotate through the link lever 36 as the solenoid drive shaft 35 moves forward or backward so that the printing unit 16 perforated with the shafts 5 and 17 press-contacts with or moves away from the platen 6. As a result, operation of the solenoid 34 by electric signals enables the printing unit 16 to move away from the platen 6 for restoration to the printing start position and press-contact with the same for starting the printing feed.

Incidentally, the link lever 36, which extends at the other end upwardly to enable abutting against the outer periphery of reduction gear 31 when the drive shaft 35 moves forward, functions as a stopper to prevent excessive press-contact of printing unit 16 with the platen 6 during the forward movement of drive shaft 35 and also as a brake to prevent the platen shaft 3 from rotation by mistake during the printing feeding.

In FIG. 4, reference numeral 38 designates a limit switch disposed opposite to the solenoid 34. A lever 39 abuts against a bush 40 projecting at the rear of link lever 36 so that the lever 36 turns as the solenoid drive shaft 35 moves forward or backward, thereby urging the lever 39 to actuate the switch 38. Hence, signals from the switch 38 detect movement of printing unit 16 away from or press-contact with the platen 6, thereby enabling control of energization to a head element 51 (see FIG. 8), resulting in an improvement in safety.

Figure 5:
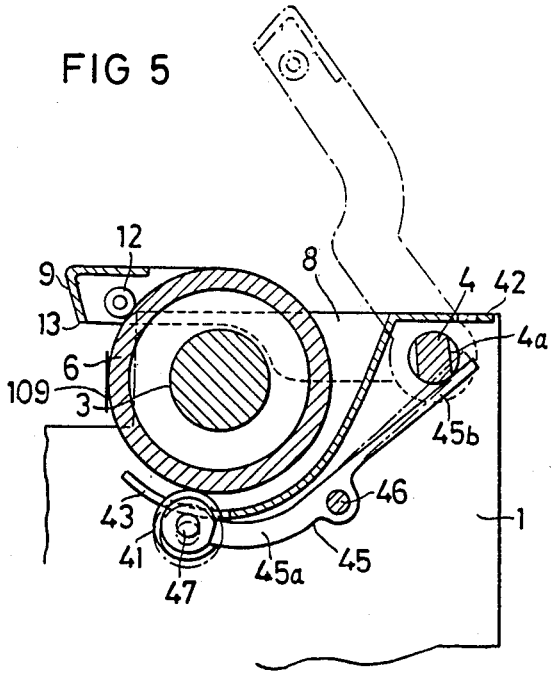
FIG. 5 is a partially omitted sectional view showing an engaging relation between a handle and a driven roller in the FIG. 2 embodiment.

Referring to FIG. 5, reference numeral 42 designates a guide plate for guiding the recording paper 10, which is fixed at one side of both ends to the side plates 1 and 2 and the other side is curved along the outer periphery of platen 6. An opening 43 is formed at a curved portion to enable a driven roller 41 to be discussed below, to abut against the platen 6.

Reference numeral 45 designates a lever formed of plastic of constant elasticity and disposed outside the guide plate 42. The lever 45 is pivoted at the central portion thereof to a shaft 46 parallel to the platen shaft 3, is curved at one side 45*a* downwardly along the guide plate 42, mounts at one end the driven roller 41 rotatably through a roller shaft 47, extends the other side 45*b* linearly slantwise upwardly, and press-contacts at the upper end of the other side 45*b* with the support shaft 4.

On the other hand, the support shaft 4 is provided at the portion corresponding to the lever 45 with two shoulders 4*a* perpendicular to the abutting portion of support shaft 4 against the lever 45 in a condition of allowing the paper holding roller 12 below the handle 9 to abut against the platen 6 (shown in the solid line).

In such construction, upon raising the handle 9 upwardly, the support shaft 4 pivoted thereto rotates to fall down the other side 45*b* of lever 45 onto the shoulder 4*a* so that an urging force of lever 45 retains the handle 9 at the position shown by the broken line in FIG. 5. On the other hand, the lever 45 rotates around the shaft 46 in an extent of rotation of shoulder 4*a*. As a result, the follower roller 41 mounted at one end 45*a* moves away from the outer periphery of platen 6, thereby making the recording paper insertable between the platen 6 and the roller 41.

Figure 6:
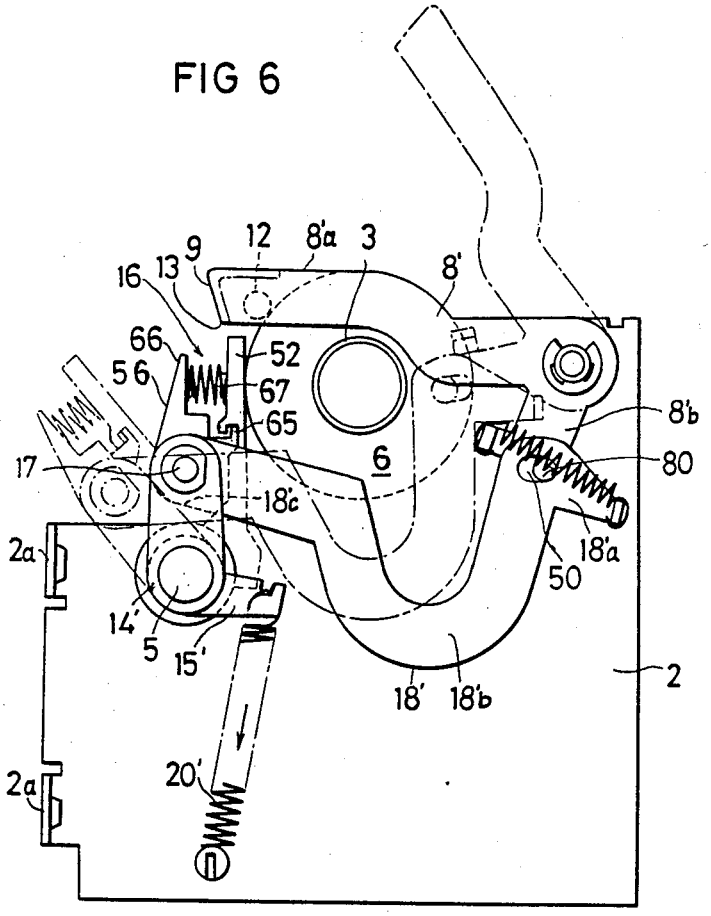
FIG. 6 is a partially omitted sectional view showing an engaging relation between the handle and a printing unit in the same.

Also, in FIG. 6, the handle arm 8' or 8 is fixed at each one axial end of handle support shaft 4 as aforesaid and extends at one end portion 8'*a* horizontally beyond the platen shaft 3 and supports at the utmost end the handle 9 and extends at the other end portion 8'*b* slantwise downwardly to support at the utmost end a stem 49 projecting at a right angle with the arm 8'.

The linkage member 18' or 18 has at one end portion an elongate slot 50 and freely engages with the arm 8' or 8 through the stem 49 and curves in a U-like shape at the other end portion 18'*b* and then extends straight, the utmost end 18'*c* thereof being pivoted to the sliding shaft 17 connected to the guide shaft 5 through the fixing member 14' or 14.

On the other hand, each coil spring 20' or 20 applying rotation to the guide shaft 5 through the retaining member 15' or 15 is subjected to the resilient force in the compression direction (in the direction of the arrow), whereby the printing unit 16, through which the guide shaft 5 and sliding shaft 17 perforate, is kept in press-contact with the outer periphery of platen 6.

In such construction, upon raising the handle 9, each arm plate 8 or 8' turns around the support shaft 4 to move each linkage member 18 or 18' while turning to the position shown by the broken line in FIG. 6 to thereby fall down (rotate) the sliding shaft 17 around the guide shaft 5, thus moving the printing unit 16 perforated with the guide shaft 5 and sliding shaft 17 away from the outer periphery of platen 6.

While, since the lever 45 retains the support shaft 4 supporting the handle 9 through each arm plate 8 or 8', by the urging force of lever 45 as shown in FIG. 5, the printing unit 16, even when the handle 9 is released from a user's hand, is kept in the position apart from the platen 6 as shown by the broken line in FIG. 5.

Then, the printing unit 16 moves away from the platen 6 to turn the link lever 36 shown in FIG. 4, thereby actuating the limit switch 38 to stop energization to the head element unit at the printing unit 16.

As a result, the handle 9 merely is raised to move away the follower roller 41 and printing unit 16 at one stroke from the platen 6, thereby simplifying the mounting or dismounting of recording paper, and improving safety because the head element unit at the printing unit 16 is deenergized simultaneously with movement thereof apart from the platen 6.

Next, explanation will be given on the rear construction of printing unit 16 in accordance with FIG. 7.

The printing unit 16 comprises a head element 51 (see FIG. 8), a head body 52 attached thereto, a head holder 53 for holding the head body 52 and sleeved onto the guide shaft 5, roller support frames 55 and 55' which are positioned slantwise rearwardly of head body 52 and to which pinch rollers 54 and 54' for peeling off from the recording paper the transfer tape stuck thereto are pivoted respectively, and a head rotating member 56 sleeved onto the sliding shaft 17 and urging the head body 52 from the rear thereof.

Figure 8:
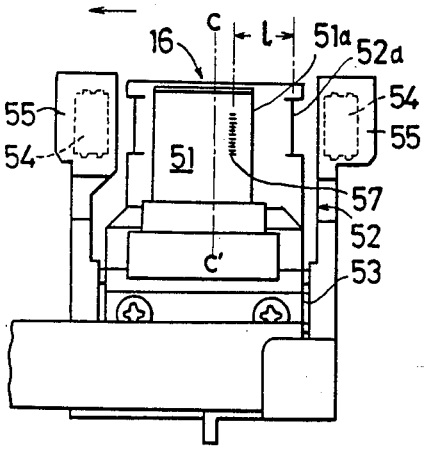

The head element 51, as shown in FIG. 8, comprises 16 dots of heating elements 57 arranged in a longitudinal row, the heat elements 57 being disposed close to the end of head element 51 in the direction of printing-return direction (in the reverse direction to the arrow).

The head body 52 is made from a metal material, such as aluminum die casting, of good heat radiation, the head element 51 being disposed substantially in the same plane as the surface of head body 52 and shifted toward the printing feed side from the center line C–C' so that a distance l between the heating elements 57 and the side edge 52*a* of the head body 52 in the printing-return direction, preferably a distance between the side edge 51*a* of head element 51 and the side edge 52*a* of head body 52, is formed larger than a width of about one character printing.

Both the side edges 52*a* and 52*b* of body 52 are cut rectangularly and round in section at the faces in contact with the transfer tape, thereby keeping the tape horizontally and preventing it from being broken.

In addition, reference numeral 58 in FIG. 7 designates connectors projecting from the rear side of head body 52 and conductive with the heating elements 57 at the head element 51 through lead wires contained in the head body 52, the head body 52 being fixed upright on the head holder 53 at the platen 6 side.

The head holder 53 has a pair of sleeves 59 and 59' sleeved onto the guide shaft 5, which sleeves 59 and 59' are press-filled therein with metals 60 and 60' and mounted slidably without play onto the guide shaft 5. Fixing members 61 and 61' project from the sleeves 59 and 59' to fix both ends of the belt 29 respectively as abovementioned so that the belt 29 travels to move the printing unit 16 onto the guide shaft 5.

The roller support frames 55 and 55' are mounted upright at the outer end sides of sleeves 59 and 59' and positioned slantwise rearwardly of head body 52 respectively, the pinch rollers 54 and 54' being pivoted to the rear upper ends of support frames 55 and 55' through pairs of mounting bases 62, 63 and 62', 63' disposed vertically respectively. In addition, reference numerals 64 and 64' designate tape holders which are mounted behind the lower mounting bases 62 and 62' respectively, thereby preventing the transfer tape from slacking.

The head rotating member 56 is positioned at the rear side of head body 52, fixed at the lower end to the head holder 53, provided at the central portion with a through bore parallel to the sleeved bore to insert the sliding shaft 17 into the through bore, and retains the head body 52 by means of a pawl 65 as shown in FIG. 6. Also, the head rotating member 56 has at the upper portion a rectangular stepped portion 66 so that a coiled spring 67 is interposed between the stepped portion 66 and the head body 52, thereby expecting the buffer effect of striking force of head element 51 during the press-contact with the platen 6, and the uniform press-contact strength.

Figure 9:
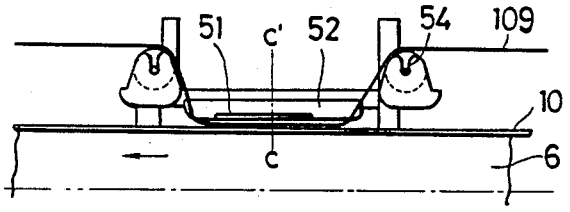
FIG. 9 is an illustration of operation of the printing unit.

In the above construction, the transfer tape 109, as shown in FIG. 9, is interposed between the recording paper 10 and the head body 52 from the rear of each pinch roller 54 or 54', the transfer tape 109 is kept stretched during the printing for one line without being fed and taken up every printing as discussed below. While, since the distance l between the heating elements 57 and the side edge 52*a* of head body 52, preferably between the side edge 51*a* of element 51 and the side edge 52*a*, is made larger than the width of about one character printing as aforesaid, the printing unit 16, during the printing, brings the transfer tape 109 just after printing into contact with the head body 52 surface having the heat radiation effect between the heating elements 57 and the side edge 52*a* of head body 52 and thereafter peels off the tape therefrom by use of pinch rollers 54 and 54', thereby rapidly cooling the molten transfer agent just after printing and enabling an improvement in printing quality and the printing at high speed.

Incidentally, this printer carries out feed of the tape (unused) and winding-up of the same (after use) during the step of restoration of printing unit 16, but in case that the tape is wound up just after printing at the line end, the transfer agent leads to peeling-off as it is still molten, so that the deterioration of printing quality also is not avoided. Therefore, the printing unit 16 is controlled to feed the tape for at least one character without printing and then start its restoration, thereby preventing the printing quality at the line end from lowering.

Figure 10:
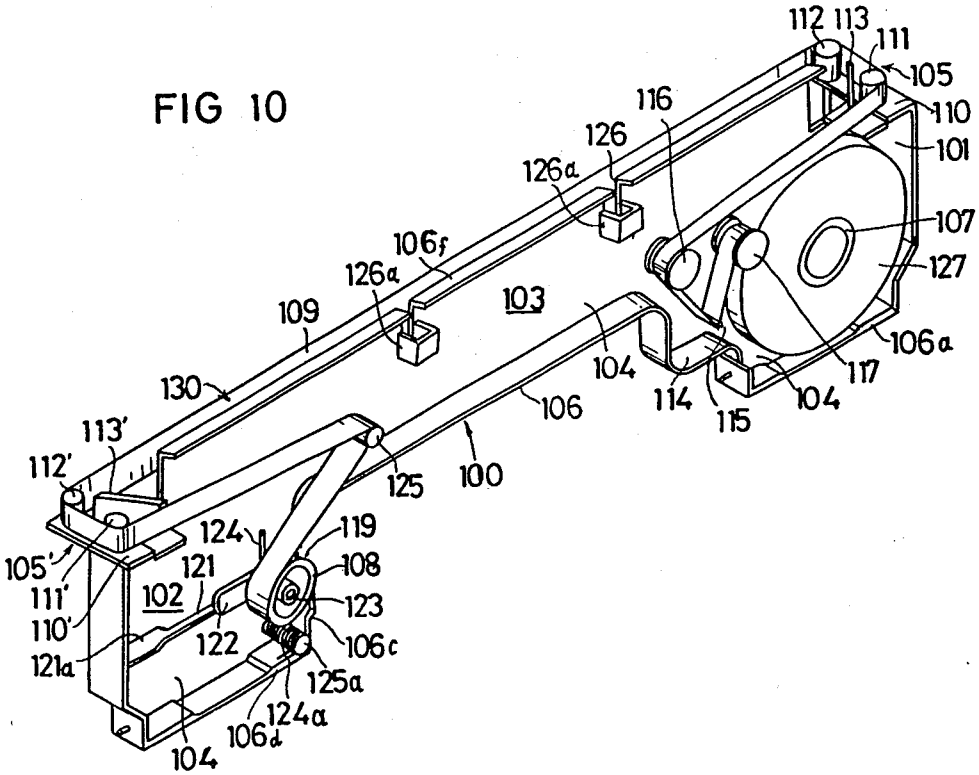
FIG. 10 is a perspective structural view of a tape cassette.
Figure 11:
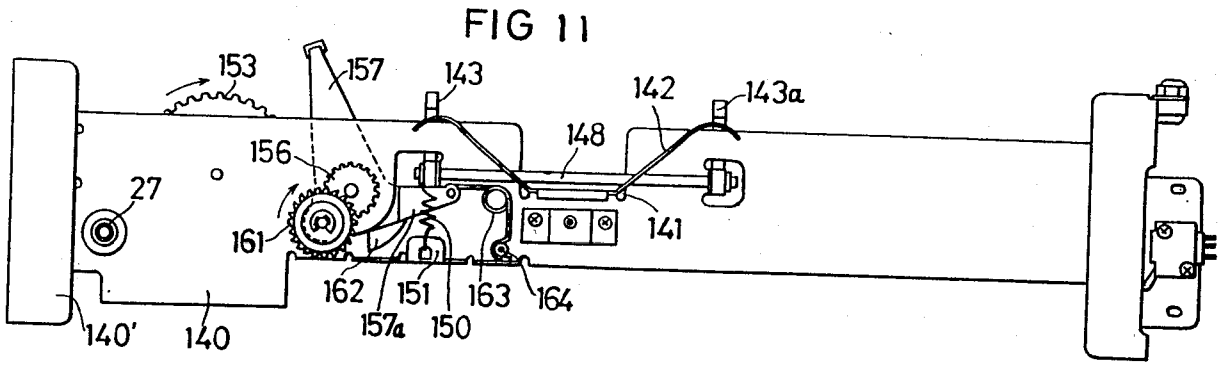

Referring to FIG. 10, a tape cassette C is formed of plastics and comprises a casing body 100 which surrounds the spool mounting surface 104 with a side wall 106 and a lid (not shown) pivoted to the body 100 to be desirably open.

The casing body 100 also comprises a pair of housings 101 and 102 disposed at both sides thereof and containing the supply spool 107 and take-up spool 108 respectively, and a bridge 103 for connecting both the housings 101 and 102.

The pair of housings 101 and 102 are provided at the upper portion of spool mounting surface 104 with tape guides 105 and 105' each projecting perpendicularly toward the printer body A with respect to the mounting surface 104.

The tape guides 105 and 105' are symmetrical with each other and comprise guide plates 110 and 110' forming the tape support faces respectively, two guide rollers 111 and 112 and those 111' and 112' erected on the tape support faces respectively, and side plates 113 and 113' erected at the inner edges of guide plates 110 and 110' respectively.

Figure 13:
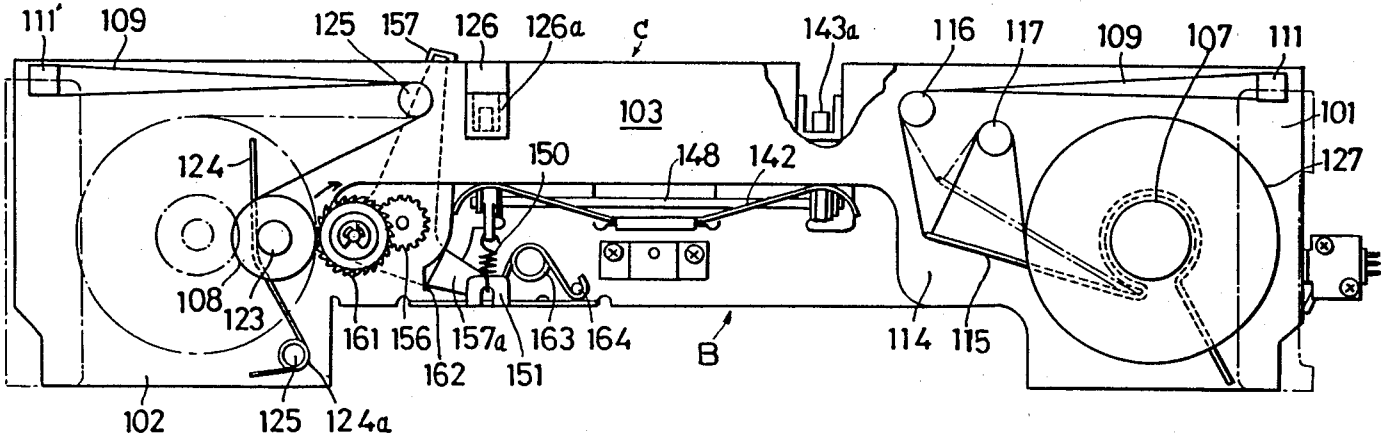
Figure 14:
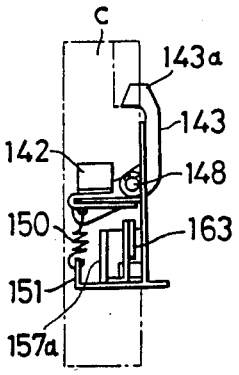

The right-hand housing 101 is swollen at an inner corner in continuation of bridge 103 to form a space 114 in which a spring 115 for back tension is freely movable and pivotally supports at the center a supply spool 107 and fixedly sleeves the spring 115 onto the outer periphery of the root end of spool 107 as shown in FIG. 13.

The back tension spring 115 extends at one end into the space 114 and bent at the utmost end at a right angle so as to hook the transfer tape 109 and is retained at the other end to the lower side wall 106*a* at the housing 101.

Guide rollers 116 and 117 are disposed above the space 114 and upright on the mounting surface 104, one guide roller 116 is disposed at the upper and right-hand portion of bridge 103 and apart sufficiently from the tape guide 105 so as to facilitate the angle-change of transfer tape 109. The other guide roller 117 is used to enlarge the stroke of transfer tape 109 retained to the back tension spring 115 and disposed in the vicinity of a tape supply reel 118.

On the other hand, the left-hand housing 102 is cut out at the inner side wall 106*c* in continuation of the bridge 103 rectangularly to form a window 119 and an elongate groove 121 is formed at the mounting surface 104 in the vicinity of window 119, the groove 121 extending longitudinally of the tape cassette across about overall length of housing 102. The elongate groove 121 is made larger in width at the outer end to form a wide groove 121*a* in continuation of groove 121 so that a tape take-up guide 122 to be discussed below is removable through the wide groove 121*a*.

The tape take-up guide 122 having a spool mounting shaft 123 projecting from the surface of guide 121 is inserted slidably into the elongate groove 121, the spool mounting shaft 123 rotatably carrying the tape take-up spool 108.

A take-up spring 124 applies always constant tension to the take-up spool 108 regardless of an amount of wound tape, is coiled 124*a* onto a projection 125*a* provided at the lower portion of housing 102, retained at one end to the bottom wall 106*d* at the housing 106, and bent at the other end to press-contact with the outer periphery of spool mounting shaft 123 thereby applying a resilient force to the take-up spool 108 toward the window 119 (see FIG. 13).

Referring again to FIGS. 10 and 13, a guide roller 125 is erected on the spool mounting surface 104 in the upper portion of bridge 103 and symmetrical with the guide roller 116.

The bridge 103 is recessed at the lower wall 106*b* overall lengthwise thereof so that an elastic member 142 to be discussed below abuts against the lower wall 106*b*, and provided at the upper wall 106*e* with U-like-shaped grooves 126, in which pockets 126*a* are provided for retaining pawls 143*a* at retainers 143 to be discussed below respectively.

Next, explanation will be given on a mounting method of transfer tape 109 for the above construction. At first, the tape reel 127 winding thereon the transfer tape 109 is fitted onto the supply spool 107, the tape 109 is drawn out from the reel 127 and retained to the guide roller 117, tip of back tension spring 115, and guide roller 116 in order, and then twisted at an angle of 90° to reach the tape guide 105. The tape 109 is retained to the guide rollers 111 and 112 at the tape guide 105 and taken out to the rear side of mounting surface 104 and transported therealong to reach the other tape guide 105'. Then, the tape 109 is retained to the guide rollers 112' and 111' at the tape guide 105', drawn into the housing 102, twisted at an angle of 90° reversely to the aforesaid twisting, retained to the guide roller 125, and then fixed to the outer periphery of take-up spool 108. Lastly, the lid engages with the casing body 100 and fixed thereto by use of an adhesive tape or the like and thereafter the supply spool 107 is rotated to eliminate the slack of tape in tape reel 127, and the cassette C is mounted to the cassette mounting mechanism B.

Incidentally, the take-up spool 108 is held to the edge of window 119 by a biasing force of take-up spring 124, whereby no slack is produced in the tape when the take-up spool 108 reversely rotates. Also, since the back tension spring 115 retains the transfer tape 109 through the guide rollers 116 and 117, the tape 109 has the stroke two times the free movement of spring, thereby further increasing the slack prevention effect for the tape.

Hence, the transfer tape 109 is stretched without the slack throughout the spool mounting surface 104, and between the transfer tape 109 and the spool mounting surface 104 is formed a space 130 in which the printing unit 16 is movable substantially throughout the casing body 100 widthwise thereof. In addition, the space 130 is long equal to the maximum line length (the maximum number of characters × character pitch in one line) plus the feed of unit 16 for one character without printing.

Now referring to FIGS. 11 through 14, a frame 140 is provided at both lengthwise ends with guide portions 140' each bent in a L-like shape and having a width insertable of the tape cassette which is mounted to the edges 1*a* and 2*a* at the side plates of printer body A.

Also, the frame 140 is bent at the upper central portion 141 perpendicularly toward the cassette mounting side and a leaf spring 142 is disposed on the bent portion 141, the spring 142 is curved upwardly at both ends so that, when the tape cassette C is mounted to the frame 140, the curved portions are pressed downwardly by the lower surface of lower wall 106*b* at the bridge 103.

Retainers 143 for retaining the tape cassette have pawls 143*a* at both ends respectively, the bases 143*b* at pawls 143*a* perforating cutouts 146 and 146' bored at both sides of central bent portion 141, thereby being fixed to a support shaft 148.

A tongue 149 extends laterally from one side of one retainer base 143*b* so that a compression spring 150 is retained between the tongue 149 and a bent segment 151 at the lower portion of frame 140. The support shaft 148 is disposed between the spring 142 and the frame 140, extends in parallel thereto, and is pivoted with respect to the frame 140 through bent segments 140*a*.

Figure 12:
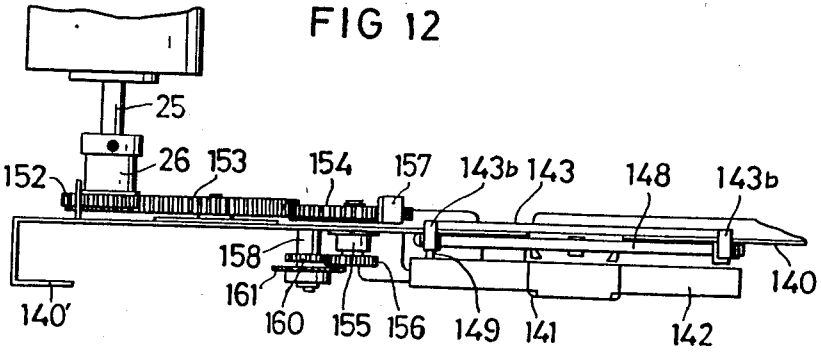

Referring to FIG. 12, a gear 152 supported by a mounting shaft 27 projecting from a pulley 26 is disposed at the one end portion of frame 140 and the printer body A side, houses a one-way clutch to be made rotatable counterclockwise only, and enganges with a gear 154 through a larger diameter reduction gear 153 pivoted to the frame 140, the larger diameter reduction gear 153 projecting at the toothed portion upwardly from the frame 140 to thereby be used also as a hand-operated tape take-up gear.

The gear 154 is pivoted to the frame 140 and its support shaft projects toward the cassette mounting side and carries at the utmost end a pinion 156.

A link lever 157 is interposed between the gear 154 and the frame 140 and fixed at the center to the support shaft 155. A shaft 158 is mounted to an angular corner of link lever 157, extends in parallel to the support shaft 155, projects toward the cassette mounting side through the opening at the frame 140 (see FIG. 2), and fixedly supports at the utmost end a follower gear 160 and a take-up scratch 161 of toothed outer periphery, the follower gear 160 engaging with the pinion 156.

Also, the link lever 157 is bent at the other side in about L-like shape, the bent portion 157*a* perforating toward the cassette mounting side through the opening 162 at the frame 140 so as to be positioned below the retainer base 143*b*. A lever spring 163 is retained between the utmost end of link lever 157 and a projection 164 at the lower end of frame 140.

The lever spring 163 has an elastic force enough to overcome the sum of elastic forces of compression spring 150 and spring 142 so that the elastic force of lever spring 163 allows the upper edge of bent portion 157*a* at the link lever 157 to normally urge the lower end of tongue 149 at the retainer 143 to thereby hold the link lever in its operation position.

In addition, in this cassette mounting mechanism, a gear ratio is so decided that the peripheral speed of pulley 26 disposed at the printer body side coincides with that of take-up scratch 161 in association with the pulley 26 through the gears 152, 153, 154, 156 and 160.

Next, explanation will be given on the tape cassette mounting method by the cassette mounting mechanism. At first, the tape cassette C is inserted into the frame 140 along the guides 140' so that the spring 42 is brought into press-contact with the lower wall 106*b* at the bridge 103, the link lever 157 is turned clockwise (in the direction of the arrow in FIG. 11) to move the end 157*a* downwardly to release the tongue 149 at the retainer 143, and the retainer is raised to retain the pawl 143*a* to the pocket 162*a* at the tape cassette C, thereby fixing the cassette C. At the same time, the take-up scratch 161 pivoted to the shaft 158 rotates clockwise (in the direction of the arrow in FIG. 11) by the follower gear 160 in engagement with the pinion 156 connected to the link lever 157 and support shaft 155, and shifts around the axis along the pinion 156. Also, the take-up scratch 161 press-contacts with the outer periphery of take-up spool 108 through the windows 119 open at the side walls 106*b* and 106*c* at the left-hand housing 102 at the cassette C and rotates to allow the take-up spool 108 to rotate. As a result, the transfer tape 109 between the recording paper 10 and the printing unit 16 is subjected to the predetermined tension to be stretched always horizontally without shifting, thereby not only preventing the printing quality of tape 109 from deterioration caused by the shifting at the beginning of printing but also eliminating troublesome stretching operation of tape because the tape is automatically stretched.

Next, explanation will be given on the tape cassette C removing method. The lever 157 is operated in the reverse direction to fall down the retainer 143 so that the pawl 143*a* releases the pocket 126*a*, the take-up scratch 161 turns downwardly and releases, while rotating in the direction of the arrow, the take-up spool 108 from press-contact. Hence, the tape cassette C is discharged upwardly by the resiliency of spring 142 under press-contact by the lower wall 106*b* of bridge 103, and the take-up spool 108 automatically moves along the elongate groove 121 by means of the biasing force of take-up spring 124, so that no slack is produced in the take-up spool 108 during the removal of tape cassette C, and also a control circuit can be adapted to be cut in association with the removal of cassette C, thereby facilitating the removal of tape cassette C and preventing the occurrence of various trouble during the removal of cassette C.

In addition, the cassette mounting mechanism has all the aforesaid parts mounted to both the surfaces of frame 140, and for coupling the frame 140 with the printer body, the gear 152 fitted onto the mounting shaft 27 projecting from the pulley 26 disposed at the body A need only be engaged with the larger diameter reduction gear 153 pivoted to the frame 140. Hence, the printer body A and cassette mounting mechanism B are producible separately from each other and the printer body is usable together with a thermal printer, thereby expecting the largely low manufacturing cost due to mass-production.

Furthermore, brief explanation will be given on the printing operation in the order of steps thereof.

Firstly, the handle 9 is operated to feed the recording paper 10 onto the platen, the tape cassette C is charged, and the transfer tape 109 is interposed between the recording paper 10 and the head body 52 from the rear sides of pinch rollers 54 and 54' as shown in FIG. 9.

After a finish of the above preparatory operation, an operating switch is turned on to move the solenoid drive shaft 35 forwardly, the printing unit 16 is press-contacted on the recording paper 10, the pulse motor 24 is driven to rotate the belt 29, and the line spacing by the printing unit 16 fixed to the belt 29 is carried out.

On the other hand, since the gear 152 supported to the mounting shaft 27 projecting from the pulley 26 shaft is adapted to rotate only in the direction of the arrow (counterclockwise) by the one-way clutch housed in the shaft 26, the gear does not rotate during the line spacing of printing unit 16, thereby carrying out printing operation for one line while the tape 109 is being stretched.

Then, at the line end, after the printing unit 16 is fed without printing, the solenoid drive shaft 35 moves backward to move the printing unit 16 away from the recording paper 10 and deenergize the printing unit 16. Next, upon receiving a signal of backward movement of drive shaft 35, the pulley 26 is rotated in the direction of the arrow (counterclockwise), whereby the printing unit 18 is restored, the gear 152 rotates, and the take-up scratch 161 rotates through the gears 153, 154, 156 and 160, thus winding up the tape with respect to the printing unit 16.

The above operation is repeated subsequently.

Incidentally, since the pulley 26 and take-up scratch 16 are synchronized in the peripheral speed, the relative speed of printing unit 16 to the transfer tape 109 becomes substantially zero, thereby enabling the head element 51 to be prevented from stain and the tape to be wound up of the portion only after use.

Also, such mechanism need not carry out the windingup of tape at every printing and the stepped movement of tape cassette carriage, whereby it is possible to largely save power consumption and use a pulley driving pulse motor of small rating and also materialize a portable printer driven by batteries.

In addition, after winding-up the tape, the link lever 157 as aforesaid need only be operated to remove the tape cassette C.

As seen from the above, this invention can provide a small-sized and lightweight printer which can be disposed upright, slantwise, or at an optional space, the tape cassette housing therein the spools for the transfer tape, so that the apparatus as a whole is miniaturized, the troublesome tape winding at every printing is eliminated, the tension of tape is kept always constant, and the cooling of transfer agent by the thermal conductor just after printing and the feed of tape for one character without printing, prevent the printing from being stained, thereby obtaining the printing distinct and superior in quality.

While an embodiment of the invention has been shown and described, the invention is not limited to the specific construction thereof, which is merely exemplary in the specification rather than defined.

I claim:

1. A printer which allows a plurality of heating elements disposed on a thermal head to selectively generate heat to thereby melt a transfer material coated on a printing tape and transfer said material onto a recording medium, said printer comprising: a printer body provided with a thermal head printing feed mechanism, a head restoration mechanism for restoring said head to the beginning of a print line, and a recording paper setting mechanism; a tape cassette comprising a supply reel for supplying said tape, a take-up reel for collecting said tape, and means for stretching said tape throughout the overall length of space provided for the movement of said head; means for mounting said cassette so that the axes of said reels are approximately orthogonal to the plane defined by said stretched portion of tape; and a tape take-up mechanism which winds up said tape so that the relative speed thereof to said head becomes substantially zero during the restoration process of said head.

2. A printer according to claim 1, wherein said head at the line end is fed for at least one character without printing, prior to restoration of said thermal head to the beginning of the next print line.

3. A printer according to claim 1, wherein said thermal head includes a head body formed of metal of thermal conductivity and having a side through which said printing tape is fed, and wherein said plurality of heating elements is mounted on the head body and adjacent the side of said head body through which said printing tape is fed.

4. A tape cassette for holding a printing tape having a layer of ink thermally transferable to a printing surface, for mounting in a printing apparatus which includes a thermal print head having a plurality of heat generating elements, and a carriage for carrying said print head along a line of printing wherein the path of the heat generating elements defines a print plane, said tape cassette comprising:

a supply spool for supplying said printing tape;

a take-up spool on which said printing tape is wound after said thermal head has passed over a line of printing;

a casing accomodating said supply and take-up spools and having means for rotatably mounting the supply and take-up spools within the casing so that the axes of rotation of said spools are generally perpendicular to the print plane of the printer when mounted in the printer apparatus, said casing including: a pair of housings disposed at both sides of said casing for containing said supply spool and said take-up spool respectively; a bridge for connecting said housings; a pair of tape guides each projecting perpendicularly toward the front surface of the printing apparatus; a back tension spring; and a pair of guide rollers disposed upright on said mounting surface, one of said guide rollers being disposed at the upper right hand portion of said bridge and sufficiently apart from said tape guide so as to facilitate a 90° angle change in the orientation of said printing tape, said second guide roller being disposed in the vicinity of said supply reel and used to enlarge the stroke of said printing tape retained to said back tension spring.

5. A tape cassette according to claim 4, wherein said tape guides are symmetrical with each other and comprise guide plates forming tape support faces respectively, each of said tape support faces having two guide rollers erected thereon, to aid in facilitating the 90° angle change of said printing tape.

6. A printing apparatus using a printing tape having a layer of material thermally transferable to the printing surface of a sheet of paper, comprising:

paper support means for holding said sheet of paper;

a thermal print head having a plurality of selectively activated heat generating elements;

a carriage carrying said thermal print head and movable along a line of printing;

carriage drive means for moving said carriage along said line of printing;

a cassette mounting member disposed along the front of said printing apparatus;

a tape cassette mounted in a vertical position on said mounting member, and comprising: a supply spool and take-up spool, which spools are rotatably mounted within said cassette, a length of said printing tape being stretched between said spools and extending throughout the length of said line of printing and being held in contact with said sheet of paper while said carriage carrying said head is placed in a printing position proximate said sheet and is moved relative to said sheet; and a tape take-up means which winds up said printing tape after said thermal print head has reached the end of a line of printing, in such a manner that the relative speed thereof to the thermal head is substantially zero, said take-up means being in working cooperation with said carriage drive means.

7. A printing apparatus according to claim 6, further comprising a printing feed mechanism for said thermal head and a return mechanism for returning said thermal head to the beginning of a print line.

8. A printing apparatus according to claim 6, wherein said cassette mounting member is detachable from the main printer body.

9. A printing apparatus according to claim 6, wherein said tape cassette is detachably mounted on said cassette mounting member.

* * * * *